US005261354A

United States Patent [19]

Jonsson et al.

[11] Patent Number: 5,261,354

[45] Date of Patent: Nov. 16, 1993

[54] PFBC POWER PLANT

[75] Inventors: Arne Jonsson; Sven-Olov Östman, both of Finspong, Sweden

[73] Assignee: ABB Carbon AB, Finspong, Sweden

[21] Appl. No.: 946,334

[22] PCT Filed: Apr. 24, 1991

[86] PCT No.: PCT/SE91/00292

§ 371 Date: Nov. 9, 1992

§ 102(e) Date: Nov. 9, 1992

[87] PCT Pub. No.: WO91/17388

PCT Pub. Date: Nov. 14, 1991

[30] Foreign Application Priority Data

May 8, 1990 [SE] Sweden ..... 9001662

[51] Int. Cl.[5] ..... F22B 31/00

[52] U.S. Cl. ..... 122/4 D; 122/6 A; 122/235.23

[58] Field of Search ..... 122/4 D, 6 A, 235.23; 110/245; 60/39.464; 422/146

[56] References Cited

U.S. PATENT DOCUMENTS 3,530,835 9/1970 von Wiesenthal .
4,479,458 10/1984 Goidich et al. .
4,537,156 8/1985 Rees .
4,760,817 8/1988 Jonsson ..... 122/4 D
4,790,267 12/1988 Mollenhoff et al. .

*Primary Examiner*—Edward G. Favors
*Attorney, Agent, or Firm*—Pollock, Vande Sande & Priddy

[57] ABSTRACT

A PFBC power plant with a combustor (3) enclosed within a pressure vessel (1). The combustor (3) is formed as a polygonal prism with, for example, hexagonal cross section. The bed section (3a) of the combustor (3) accomodates a steam generator constructed from at least three groups (23) of plane tube discs (24), in which groups (23) the discs are oriented parallel to opposite sides walls in the combustor (3). Each tube disc (24) may comprise both evaporation and superheater tubes (25a, 25b, 25c) which may comprise tubes in several parallel planes. In a preferred embodiment, each group (23) of tube discs (24) fills up a parallelepipedic space in the lower part (3a) of the combustor (3).

11 Claims, 7 Drawing Sheets 3c
51
41
63
25b (29)
46
25c
24
25b
25a
53
3d
61
39
52

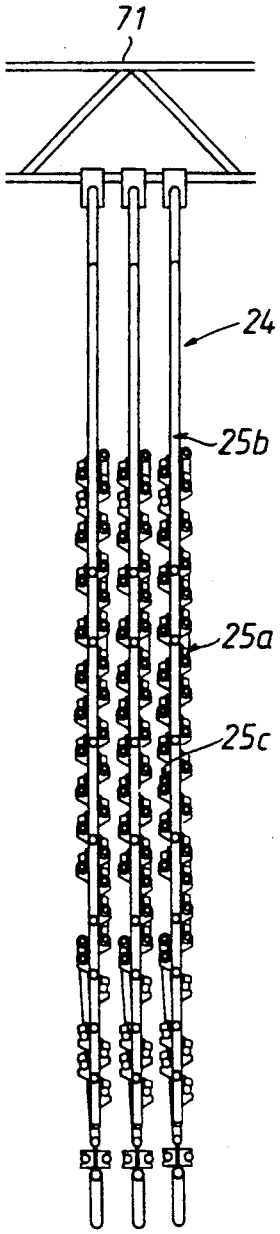
FIG. 5
FIG. 7
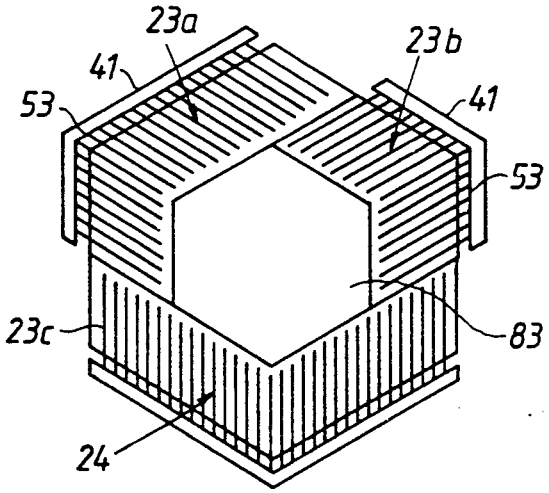

57
57a
57b
G
69
65
67
59
55
SHI out
46
63
SHI in
ISH out
51
53
SHII out
43
41
54
EVA out
31b
31a
33a
33b
29
24b
31b
31a
27b
27a
29
24a
45
47
SHII in
52
ISH in
61
EVA in
39
35
37

PFBC POWER PLANT

TECHNICAL FIELD

The invention relates to a PFBC power plant. PFBC are the initial letters of the English expression Pressurized Fluidized Bed Combustion. In a PFBC power plant the combustion is performed in a fluidized bed of particulate material, usually mainly consisting of limestone or dolomite which acts as sulphur absorbent. The combustion takes place at a pressure which considerably exceeds the atmospheric pressure. The combustor is suitably enclosed within a pressure vessel and is surrounded by compressed combustion air. The combustion gases are utilized by a gas turbine which drives a compressor, which compresses the combustion air, and a generator. The bed section of the combustor includes tube coils which absorb heat from the bed, cool the bed and generate and superheat steam for a steam turbine which drives a generator.

BACKGROUND ART

Hitherto proposed and designed commercial PFBC power plants are relatively small and have a power of up to about 200 MWe. Rectangular combustors have been used to obtain a geometrically simple construction of the tube system in the bed section of the combustor. A cleaning plane in the form of groups of cyclones for separation of dust from the combustion gases has been provided between the combustor and the surrounding pressure vessel.

The problem involved is that the hitherto proposed and designed PFBC power plants require a pressure vessel with a relatively large diameter in view of the geometrical shape of the combustor. In the first generation PFBC power plants, the advantage of the simple tube laying in rectangular combustors has made up for the additional cost of a larger pressure vessel. When doubling or multiplying the power it is important to increase the ratio between the cross-section areas of the combustor and the pressure vessel.

SUMMARY OF THE INVENTION

According to the invention, the combustor is made as a polygonal prism with at least six side walls. Most suitably, the combustor is made with hexagonal cross section with a bed section with a steam generator consisting of evaporation and superheating tubes, and a freeboard section for reception of the combustion gases from the bed. At its top, the freeboard is connected to at least one substantially vertical duct which conducts the combustion gases to a cleaning plant which is located in a space formed between the duct and the surrounding pressure vessel.

The cleaning plant comprises a number of groups of cyclones connected in series, hot gas filters, or a combination of cyclones and hot gas filters.

The combustor design and the location of the gas cleaning plant permit a considerably better ratio between combustor cross section and pressure vessel cross section. An improvement of the order of magnitude of 20% or more is possible. The reduction of the pressure vessel diameter and the necessary wall thickness of the pressure vessel entails a considerable reduction of weight and cost. Further, the shape of the combustor permits a simpler suspension. Suitably, the combustor is suspended, at its corners, from rods which are attached directly to the pressure vessel or to relatively short beams in the pressure vessel. An additional advantage with the embodiment is that the plane walls of the combustor will be shorter. This reduces the length of surrounding beams which absorb forces caused by the pressure difference between the inside and outside of the combustor. The weight and cost of the frames are reduced.

The vertical duct between the freeboard of the combustor and the cleaning plant entails a favourable outflow and mixture of the combustion gases and combustion of accompanying unburnt fuel. Further, separation of coarse particles may take place in the duct by means of simple separating devices. NOX reduction may take place in the duct by the injection of additives, for example ammonia. The duct may also be utilized as a secondary combustion chamber to increase the gas temperature and hence the gas turbine power.

According to a preferred embodiment of the invention, plane vertical tube discs are arranged in a combustor of hexagonal cross section in three groups with the tube discs in the respective group oriented parallel to two opposite side walls. In one embodiment the combustor may be designed with a hexagonal annular bed section. In another embodiment the tube discs fill up the entire hexagonal space and each of the tube disc groups fills up a parallelepipedic space.

The tube discs are oriented parallel to the side walls in the combustor. Despite the shape of the combustor, simple plane tube discs of equal size can be used in the entire combustor.

In one embodiment of the invention, the tube discs are constructed from tubes in three parallel, adjacent planes. Of the tubes of the different planes in a tube disc, at least one tube plane is included in an evaporator and one or two tube planes in a superheater. In one disc, the tubes in a central tube plane may be suspend from supporting members in the combustor and support the other tube planes.

BRIEF DESCRIPTION OF THE DRAWINGS

The invention will be described in more detail with reference to the accompanying drawings.

FIG. 1 shows a view and a section of the pressure vessel of a PFBC power plant with a combustor, a cleaning plant, and so on. FIG. 5 schematically shows an end view of a group of three tube discs which are supported by tubes in the central tube plane of the respective tube disc. FIG. 7 schematically shows an alternative way of arranging tube discs in a hexagonal combustor.

DESCRIPTION OF THE PREFERRED EMBODIMENTS

Figure 1:
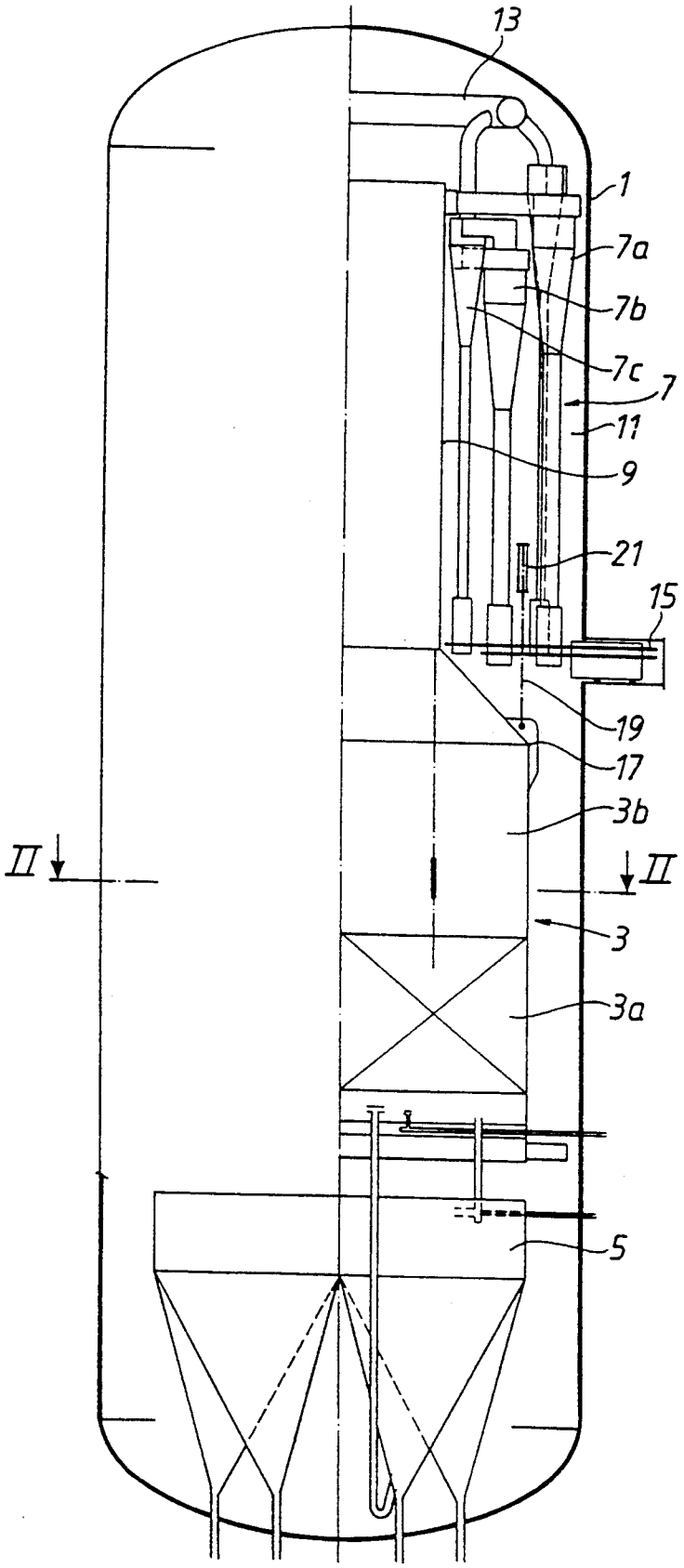
Figure 2:
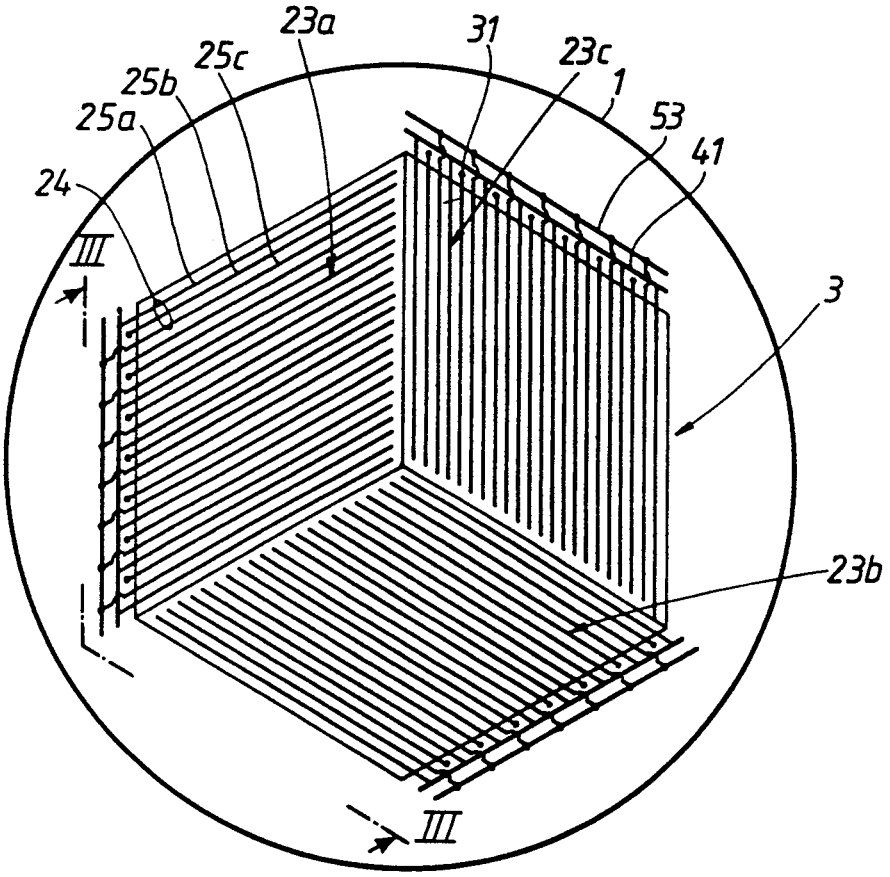
FIG. 2 schematically shows a horizontal section through the pressure vessel and the combustor at II—II in FIG. 1.

In the figures, 1 designates a cylindrical pressure vessel which encloses a combustor 3, a container 5 for receiving and storing bed material, a cleaning plant 7 consisting of a number of groups of series-connected cyclones *7a*, *7b*, *7c* as well as certain other auxiliary equipment. The lower part of the combustor 3 forms the bed section 3*a* of the combustor 3. This section accomodates heat-absorbing tubes which form a steam generator. The upper part of the combustor 3 forms the freeboard 3*b* of the combustor 3 which receives combustion gases leaving the bed of the combustor 3. The freeboard 3*b* of the combustor is connected to a duct 9 which connects the combustor 3 to the cleaning plant 7, which is located in the annular space 11 between the duct 9 and the surrounding pressure vessel 1. Cleaned gases are collected in the conduit 13 and are passed to a gas turbine included in the power plant. Separated dust is removed through a pressure-reducing cyclone ash cooler 15. As shown in FIGS. 2 and 7, the combustor 3 in a preferred embodiment has a hexagonal cross section and forms a prism. At its corners 17 the combustor 3 is suitably suspended from pendulums 19 which may be attached to brackets or beams 21 fixed to the pressure vessel.

Figure 4:
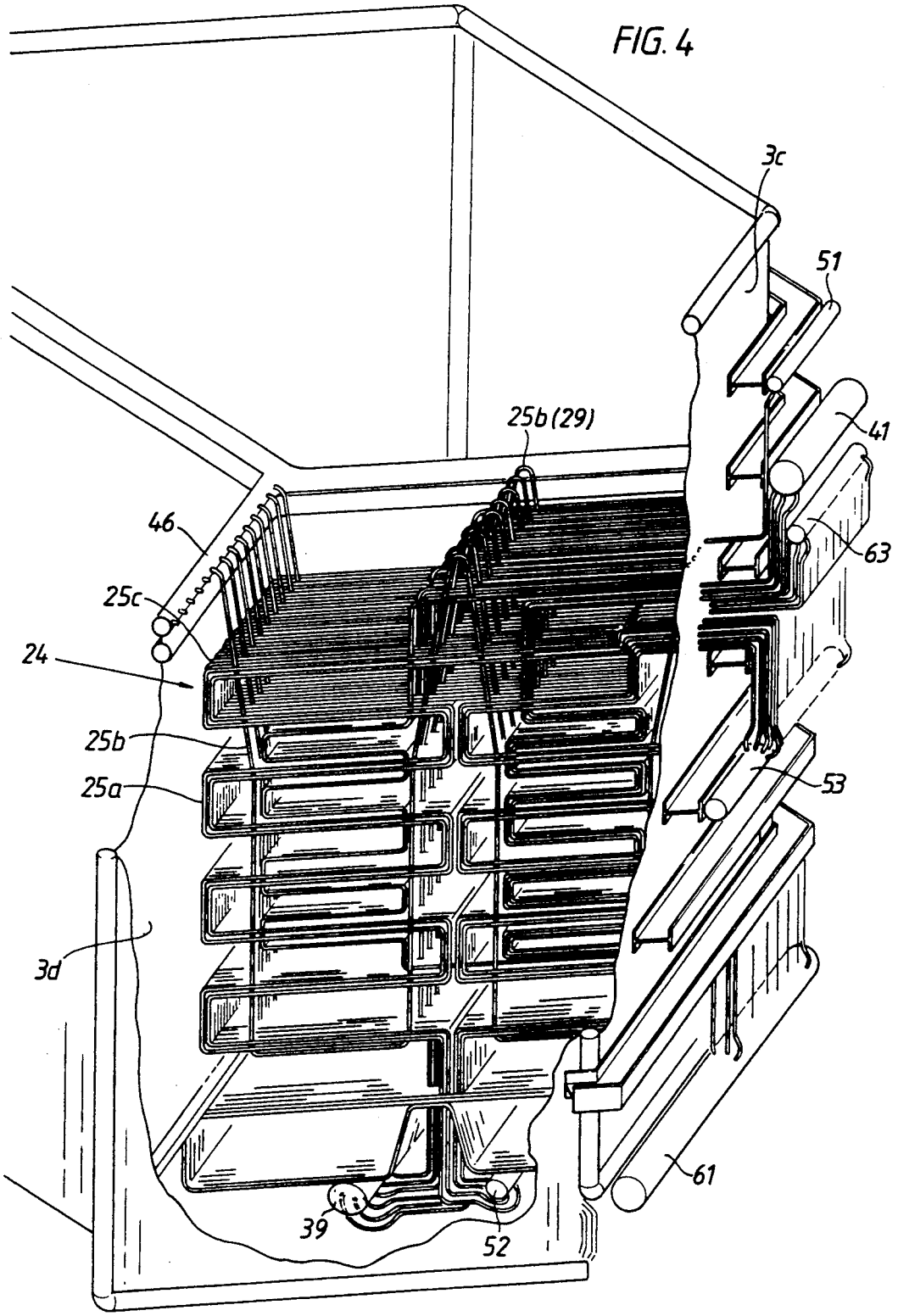
FIG. 4 shows a perspective view of a parallelepipedic group of tube discs and collecting pipes for feedwater and steam.

In the embodiment shown in FIGS. 2 and 4, the tube system 23 in the bed section 3*a* of the combustor 3 is divided into three groups 23*a*, 23*b*, 23*c* with a rhombic cross section, each of which fills up a parallelepipedic space in the bed section 3*a*. By this arrangement, a possibility is provided of completely filling up the cross section in the combustor 3 with plane parallel tube discs 24.

In the embodiment shown, each tube disc group 23 is constructed from tube discs 24 consisting of tube coils 25*a*, 25*c*, 25*c* with different functions and comprises tubes included in the evaporator (EVA), superheater I (SHI), superheater II (SHII) and intermediate superheater (ISH) of the steam generator. The composition within different tube discs 24 may vary to obtain a suitably adapted heat-transferring surface in the evaporator section and the superheater sections of the steam generator in view of the current performance requirements. The schematic FIG. 4 shows tube discs 24 with three tube coils 25*a*, 25*b*, 25*c* in each tube disc in one of the parallelepipedic spaces of the combustor 3. In such a space there may in reality be 20–40 discs 24. As will be clear from FIGS. 3, 4 and 5, the tube discs 24 are suspended from the central tube coil 25*b*. This is suspended at its mid-point from beams 71 in one of the outer walls 3*c* of the combustor 3 and in a wall 3*d* between the parallelepipedic spaces inside the combustor 3. The beams 71 are connected to the conical ceiling of the combustor 3 by cooled connecting rods (tubes) 73 and 75.

Figure 6:
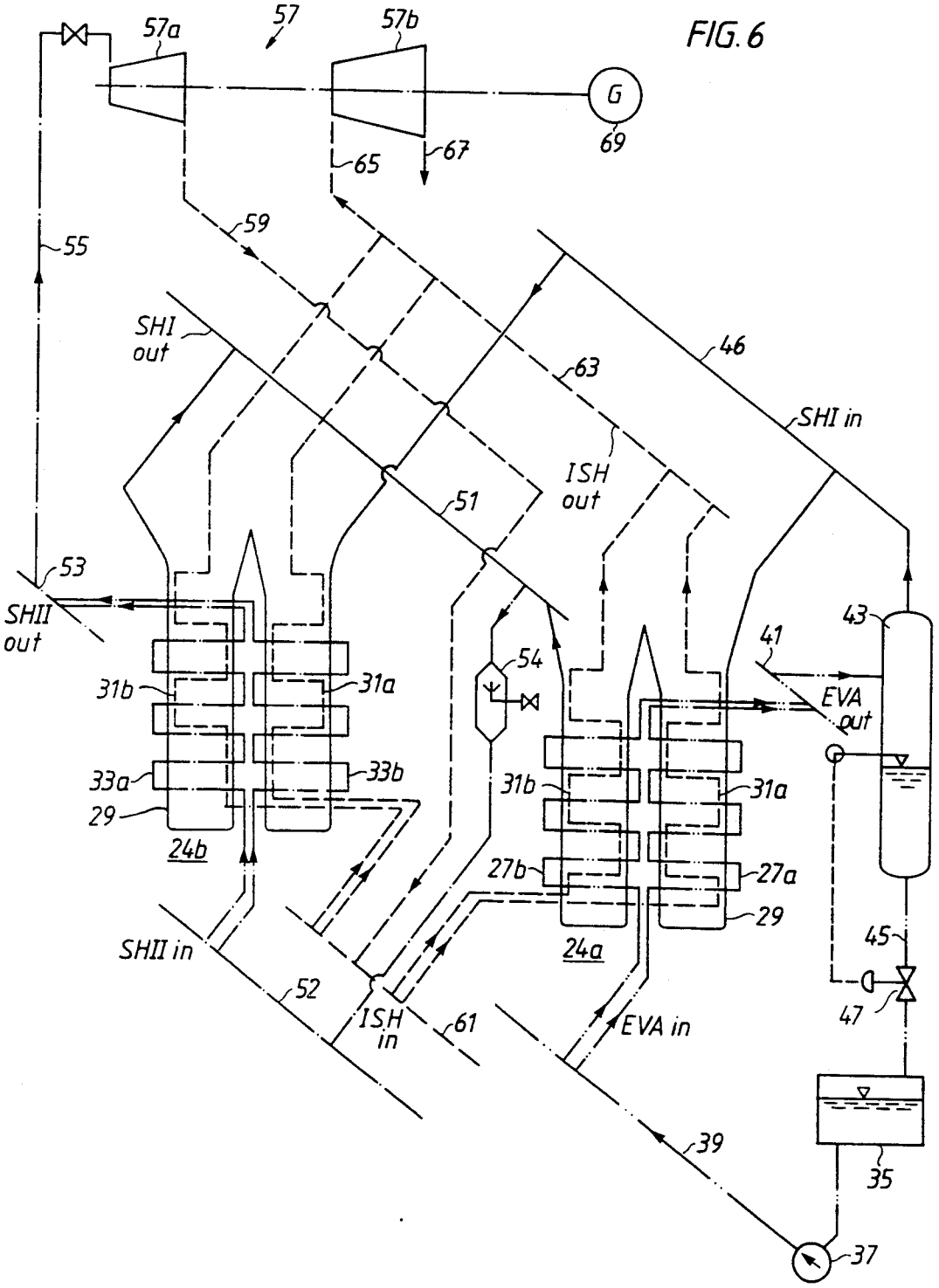
FIG. 6 schematically shows two tube discs representative of the whole steam generator and the flow through these.
Figure 8:
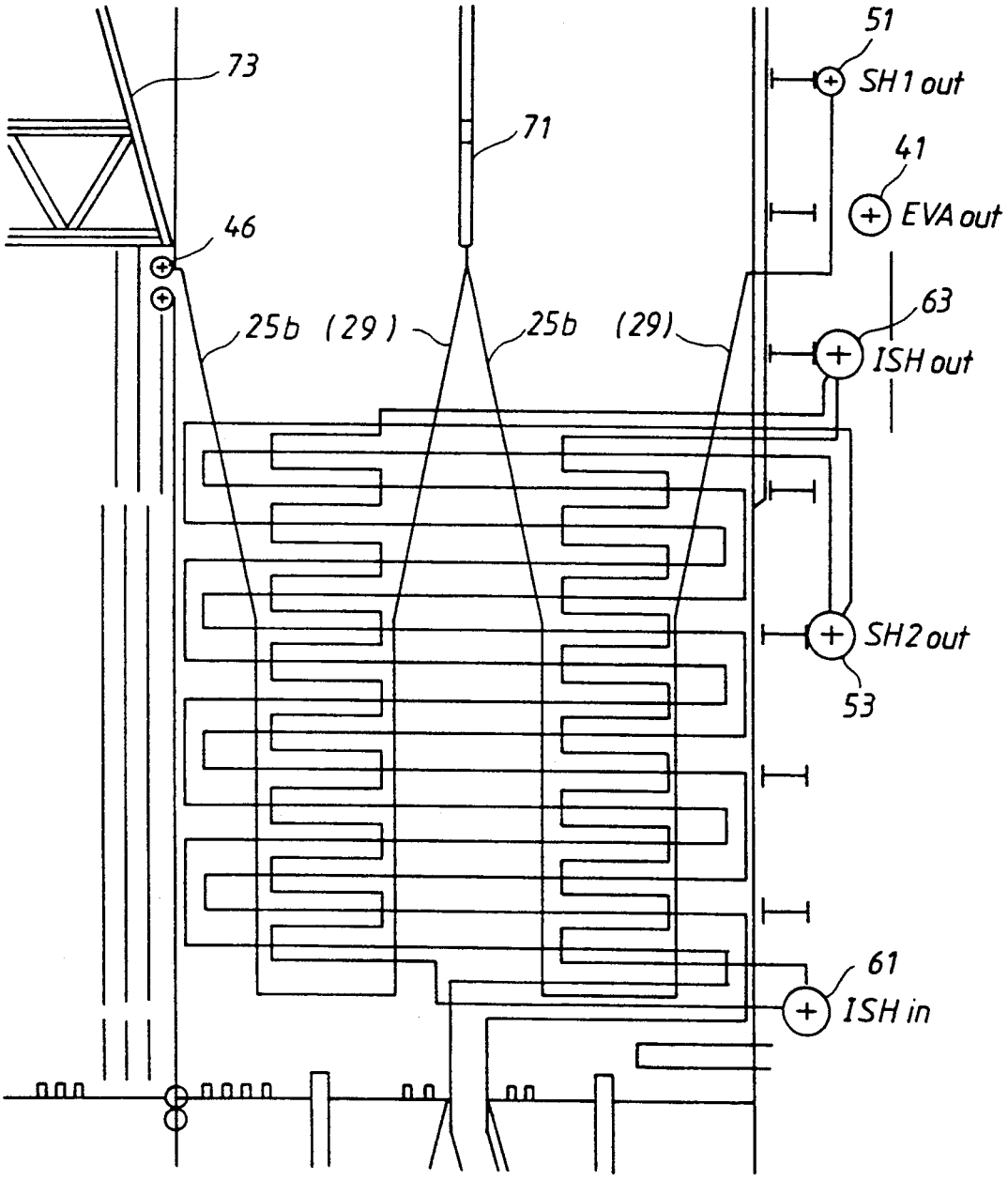
FIG. 8 shows an alternative way of arranging tubes in a tube discs.

In the embodiment of the steam generator shown in diagrammatic form in FIG. 6 there are two types of tube discs 24*a* and 24*b*. The disc 24*a* includes tubes 27 with two parallel tube coils 27*a*, 27*b* which are part of the evaporator EVA of the steam generator, a tube coil 29 which is part of a first superheater SHI and tubes 31 with two parallel tube coils 31*a*, 31*b* which are part of an intermediate superheater ISH. The tube discs 24*b* include tubes 29 which are part of a first superheater SHI, tubes 33 in two tube coils 33*a*, 33*b* which are part of a second superheater SHII, and tubes 31 in two parallel tube coils 31*a*, 31*b* which are part of an intermediate superheater ISH. The superheater tubes 29 in the first superheater SHI serve as supporting tubes. In the planes of these tubes 29 and between the vertical parts thereof, other superheater tubes may be positioned (in this case the intermediate superheater tubes 31 are shown in this position).

Feedwater from the feedwater container 35 is pumped by means of the feedwater pump 37 to the distributing pipes 39 of the evaporator and further to the evaporator tubes 27, is collected after passage through the evaporator in the collecting pipes 41 of the evaporator and is passed to the steam separator 43. Separated water is returned to the feedwater container 35 through the conduit 45 and the water level regulating valve 47 to the feedwater container 35. The steam is passed via the distributing pipes 46 of the first superheater SHI to the tubes 29 in the first superheater SHI and is collected after passage through the first superheater SHI in the collecting pipes 51 of the first superheater SHI, passes through the steam cooler 54 where the temperature of the steam is regulated by means of water injection before it is supplied via the distributing pipes 52 of the second superheater SHII to the tubes 33*a*, 33*b* of the second superheater SHII. After passage through the superheater SHII, the superheated steam is collected in the collecting pipes 53 of the second superheater SHII and is passed through the conduit 55 to the high-pressure section 57*a* of the turbine 57. The steam from this turbine section is passed in a conduit 59, via the distributing pipes 61 of the intermediate superheater ISH, to the tubes 31*a*, 31*b* of the intermediate superheater ISH, is collected after passage through the intermediate superheater ISH in the collecting pipes 63 of the intermediate superheater ISH and is returned to the intermediate and low-pressure section 57*b* of the turbine 57 and from there to a condenser (not shown) via the conduit 67.

Figure 3:
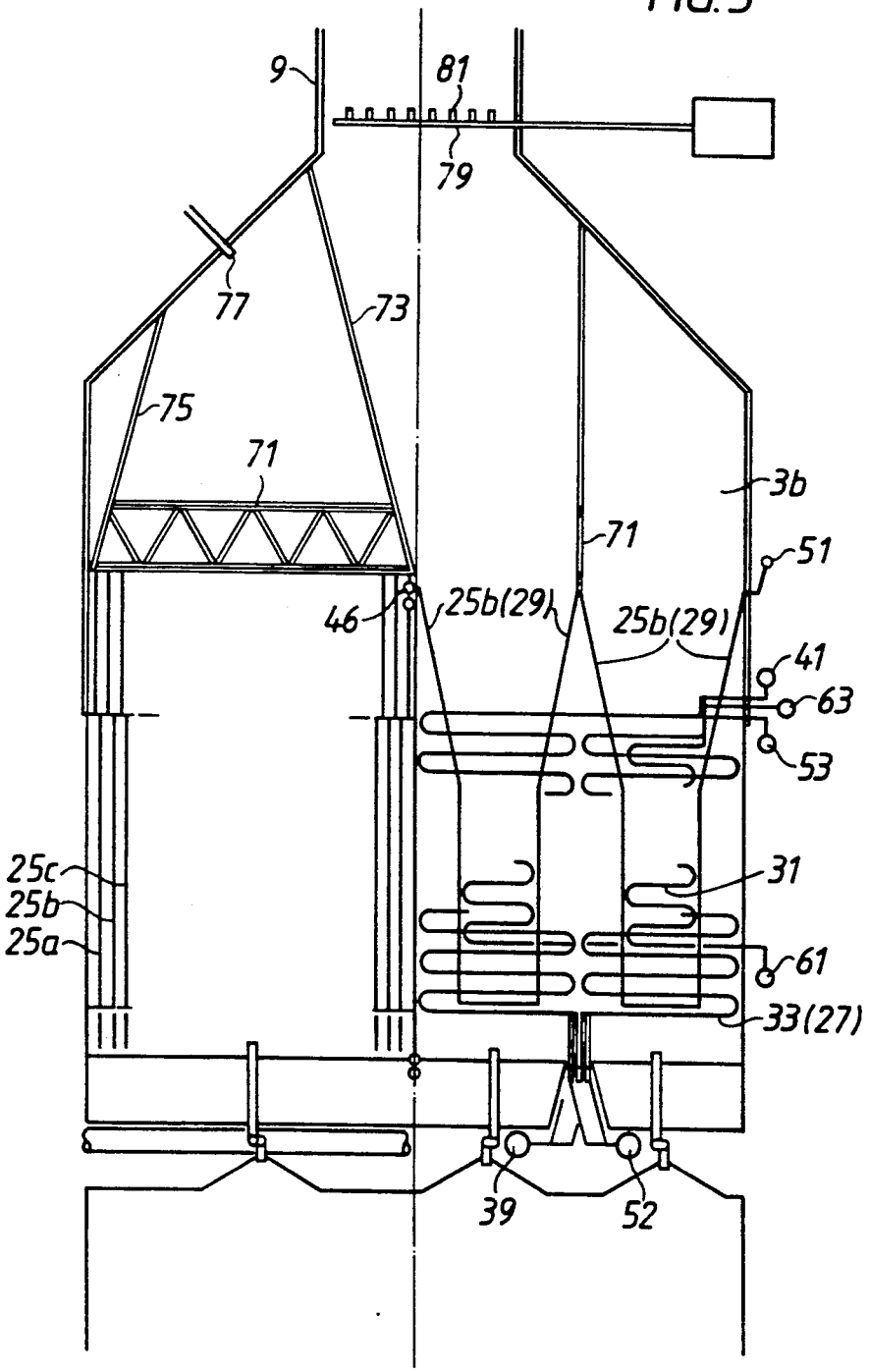
FIG. 3 shows a vertical section of the combustor at III—III in FIG. 2.

As shown in FIG. 3, the combustor may be equipped with, for example, gas-fired burners 77 in the freeboard section 3*b* or in the duct 9 to increase the gas temperature, especially in case of partial load. The duct 9 may include devices 79 with nozzles 81 for injection of a NOX-reducing substance, for example ammonia in the flue gases.

FIG. 7 shows an alternative way of arranging the tube discs 24 in a large combustor. In this arrangement, the size of the tube discs 24 is reduced. In the centrally formed space 83, auxiliary equipment may be arranged.

We claim:

1. A PFBC power plant comprising a combustor enclosed within a substantially cylindrical pressure vessel of circular cross section and wherein the cumbustor comprises one bed section and one freeboard section, the power plant also comprising a steam generator consisting of evaporation tubes and superheating tubes, and a cleaning plant for flue gases is connected to the freeboard section, wherein the combustor is formed as a polygonal prism with six side walls, the bed section of which comprises a fluidized bed which is common to the whole combustor, evaporation and superheating tubes arranged in three groups are placed in the fluidized bed, and the freeboard section comprises a freeboard which is common to the whole combustor and which receives flue gases from the fluidized bed.

2. A PFBC power plant according to claim 1, wherein evaporation and superheating tubes are designed as a number of parallel plane discs in three groups and with the discs in the respective group oriented parallel to two opposite sides in the hexagonal combustor and wherein each tube disc comprises tubes which constitute evaporation tubes and superheating tubes.

3. A PFBC power plant according to claim 2, wherein each group of tube discs fills up a parallelepipedic subvolume of the bed section.

4. A PFBC power plant according to claim 1, wherein each tube disc consists of tubes in several, preferably three planes and wherein the tube disc is suspended from the combustor in the central tube plane.

5. A PFBC power plant according to claim 1, wherein the top of the combustor is connected to at least one duct which connects the freeboard section to the cleaning plant.

6. A PFBC power plant according to claim 5, wherein the cleaning plant is housed above the combustor in the space between the duct/ducts and the walls of the pressure vessel.

7. A PFBC power plant according to claim 6, wherein the cleaning plant comprises cyclones and hot gas filters and is arranged in an annular space surrounding a central duct.

8. A PFBC power plant according to claim 1 wherein the combustor is formed with a hexagonal annular bed section which surrounds an internal hexagonal space containing auxiliary equipment.

9. A PFBC power plant according to claim 1, wherein the combustor is suspended from supporting members which are attached to the pressure vessel wall and to the corners of the combustor.

10. A PFBC power plant according to claim 2, wherein the combustor is formed with a hexagonal annular bed section which surrounds an internal hexagonal space containing auxiliary equipment.

11. A PFBC power plant according to claim 6, wherein the cleaning plant comprises hot gas filters and is arranged in an annular space surrounding a central duct.

* * * * *